US011884460B2

(12) United States Patent
Kiefiuk et al.

(10) Patent No.: US 11,884,460 B2
(45) Date of Patent: Jan. 30, 2024

(54) FOLDING PANEL PACKAGING WITH TAB LOCKS

(71) Applicant: Apple Inc., Cupertino, CA (US)

(72) Inventors: Kelsey M. Kiefiuk, Culver City, CA (US); Shannon M. McGrath, Los Angeles, CA (US); Teresa Y. Yen, Arcadia, CA (US); Hamish Thain, Brooklyn, NY (US); Megan J. Burmeister, Manhattan Beach, CA (US)

(73) Assignee: Apple Inc., Cupertino, CA (US)

( * ) Notice: Subject to any disclaimer, the term of this patent is extended or adjusted under 35 U.S.C. 154(b) by 716 days.

(21) Appl. No.: 16/992,415

(22) Filed: Aug. 13, 2020

(65) Prior Publication Data

US 2021/0061513 A1 Mar. 4, 2021

Related U.S. Application Data

(60) Provisional application No. 62/895,839, filed on Sep. 4, 2019.

(51) Int. Cl.
*B65D 5/48* (2006.01)
*B65D 5/20* (2006.01)

(52) U.S. Cl.
CPC ..... *B65D 5/48002* (2013.01); *B65D 5/2066* (2013.01)

(58) Field of Classification Search
CPC ..... B65D 5/2066; B65D 5/48002; B65D 5/4283; B65D 27/16; B65D 5/48018; B65D 5/2052
USPC ..... 229/125.39; 24/458, 453, 704.1; 220/324, 7; D9/759
See application file for complete search history.

(56) References Cited

U.S. PATENT DOCUMENTS 4,019,764 A * 4/1977 Okamura ..... F16B 5/0642 229/125.21
4,239,149 A * 12/1980 Kupersmit ..... B65D 45/16 229/125.21
4,482,074 A * 11/1984 Lalley ..... B65D 5/005 312/265.5
7,908,719 B2 * 3/2011 Liverman ..... F16B 5/0642 24/453

(Continued)

FOREIGN PATENT DOCUMENTS

BR 202012005074 U2 10/2017

*Primary Examiner* — Christopher R Demeree
(74) *Attorney, Agent, or Firm* — Sterne, Kessler, Goldstein & Fox P.L.L.C.

(57) ABSTRACT

Packaging is formed from a unitary, cross-shaped blank folded to form a packaging to hold a product. Some panels of the packaging include cutouts, and the material from the cutouts is adhered to other panels to form fastening elements to hold the box together in a closed configuration via a friction fit. This adds efficiency to the material usage of the packaging. The folded panels fold at miter cuts, such that the outward facing edges are sharp cornered and the opposing miter surfaces increase structural integrity of the finished packaging. Complementary edges of the packaging also are formed with miter cuts (or chamfer-type cuts), such that the complementary edges form a sharp corner, with opposing miter surfaces increasing structural integrity of the finished packaging at complementary edges just as at the fold lines.

27 Claims, 8 Drawing Sheets

(56) References Cited

U.S. PATENT DOCUMENTS

| | | | | |
|---|---|---|---|---|
| 8,240,469 | B2 * | 8/2012 | Goda | B65D 19/20 206/386 |
| 9,327,869 | B2 * | 5/2016 | Nakamura | B65D 19/20 |
| 9,738,420 | B2 * | 8/2017 | Miller | B65D 81/24 |
| 2009/0211068 | A1 * | 8/2009 | Xin | B65D 5/32 24/457 |
| 2009/0229092 | A1 * | 9/2009 | Xin | B65D 5/68 24/458 |
| 2011/0048990 | A1 | 3/2011 | Goda | |
| 2011/0210024 | A1 * | 9/2011 | Tanaka | B65D 5/322 206/320 |
| 2016/0107789 | A1 | 4/2016 | Itano | |
| 2016/0376081 | A1 | 12/2016 | Wang et al. | |

* cited by examiner

FOLDING PANEL PACKAGING WITH TAB LOCKS

CROSS-REFERENCE TO RELATED APPLICATIONS

This application claims priority to U.S. Provisional Patent Application No. 62/895,839 filed Sep. 4, 2019, titled "Folding Panel Packaging With Tab Locks," which is incorporated herein in its entirety by reference thereto for all purposes.

FIELD

The described embodiments relate generally to retail packaging. More particularly, the present embodiments relate to folded panel packaging using integrated tab locks for structural security, as well as miter cuts at folds and complementary edges to increase structural support for the folded panel configuration.

BACKGROUND

Packaging for consumer products may be an important marketing tool used to attract and retain customers. Packaging should be aesthetically appealing, but at the same time direct a customer's attention to the product it is designed to hold. Structural and environmental considerations may play a role in designing packaging. For example, packaging may be designed to be environmentally friendly—while retaining sufficient structure to ensure robust protection for the products contained within it.

SUMMARY

Some embodiments include packaging including a unitary, cross-shaped blank folded to form a packaging to hold a product. Some panels of the packaging include cutouts, and the material from the cutouts is adhered to other panels to form fastening elements to hold the box together in a closed configuration via a friction fit. This adds efficiency to the material usage of the packaging.

The folded panels fold at miter cuts, such that the outward facing edges are sharp cornered and the opposing miter surfaces increase structural integrity of the finished packaging. Complementary edges of the packaging also are formed with miter cuts (or chamfer-type cuts), such that the complementary edges form a sharp corner, with opposing miter surfaces increasing structural integrity of the finished packaging at complementary edges just as at the fold lines.

The packaging may be formed from a single blank, with several panels folding together to form the packaging that the product is held within. An auxiliary package that holds, for example, product accessories, additional products, or product literature, may be provided within the single panel packaging. In some embodiments, the auxiliary package is adhered to one or more panels of the packaging, thereby fixing it within the packaging. In some embodiments, a panel of the packaging includes an additional cutout, and the material from the additional cutout is adhered to the auxiliary packaging (or vice versa), such as to form a form fastening element configured to hold the auxiliary packaging to a panel of the packaging via a friction fit. The auxiliary package may further increase structural integrity of the finished packaging, allowing for the panels of the packaging to be folded around and in contact with the form of the auxiliary packaging. This adds structural support at a portion of the packaging that is amplified by the aforementioned miter cuts on complementary edges and at fold lines.

Advantageously, this improves upon prior systems having, for example, glued base boxes and lids, or other conventional boxes that produce an unfinished and not visually appealing simple structure from the outside, and rely on additional structural reinforcement or adhesive to provide structural integrity.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
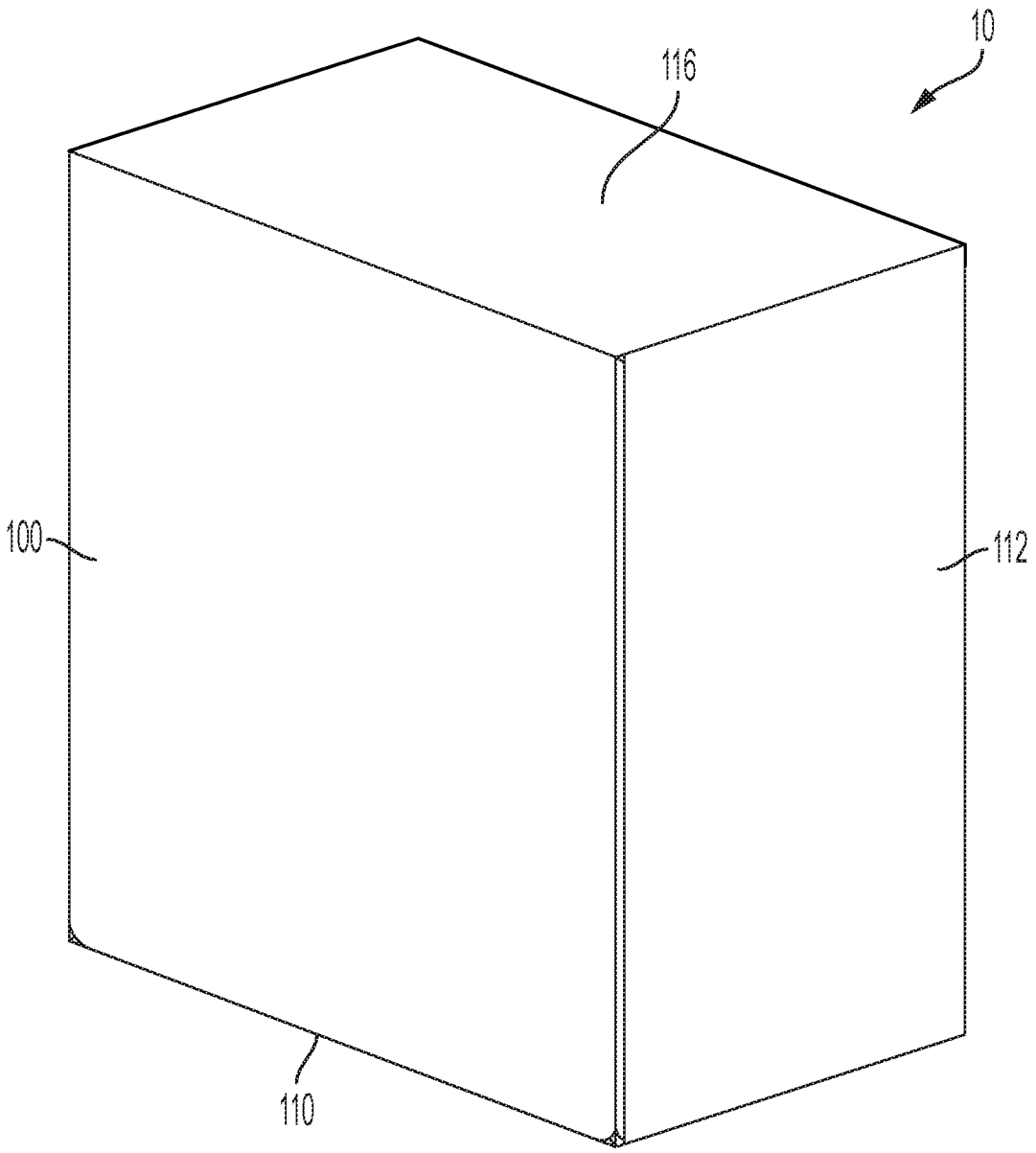
FIG. 1 shows packaging according to an embodiment in a closed configuration.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

Product packaging is an integral part of a customer's experience. It introduces the customer to their product, and can affect the customer's feelings toward the product and the company that created it. Seamless and solid-feeling packaging without unnecessary gaps between edges and components—calling to mind a unitary construction with robust character—may be particularly desirable.

Packaging should be aesthetically appealing, but at the same time direct a customer's attention to the product it is designed to hold. Packaging having gaps, defects, or imperfections can draw the customer's attention away from the product it is holding or make the product seem less appealing. For example, if a package has unfinished edges, or if the finished edges deform or warp, defects and gaps between the edges of the packaging walls may present a disjointed appearance that detracts from the customer's experience.

In the same vein, companies may be sensitive to the cost of packaging and may wish to promote packaging that is eco-friendly. Optimization of packaging in material usage may help keep costs low, and if done well may not interfere with, and may promote, a positive user experience. Packaging made out of recyclable and/or biodegradable materials, such as paper or other cellulose-based products can reduce environmental impact. Moreover, increasing stability or resistance to deflection even without having a large bulk of support material is advantageous—it avoids unnecessary bulk, weight, and cost while still ensuring that the product remains undamaged throughout transport and sale.

Packaging that is interesting in character and well-executed may boost a product's or a brand's reputation, thereby attracting new customers and retaining previous customers.

Packaging described in this document achieves these and other beneficial characteristics by balancing smart connectivity and efficiency, structural robustness, eco-friendly materials, and aesthetic elements.

In some embodiments, a box is formed from folded panels from a single integral component, having miter cuts at folds and complementary edges. The panels form a generally cross-shaped configuration when unfolded completely. This allows for the front of the box to be folded open and away from two internal side panels that fold away to reveal a product housed within the packaging. Additionally, because the packaging folds open flat, the product can just be picked up without any interference (e.g., a customer does not have to reach down into a box or slide the product out of a box. By opening flat, the box totally gets out of the way of the customer. The front of the box is coupled to the side panels with tab locks, and the tab locks are formed from a cut-out shape of the internal side panels—the cut material is adhered to the interior surface of the front panel and is configured to provide a friction fit that mates with the cut out portion of the side panels.

An auxiliary package may be disposed within the packaging and positioned such that the panels contact surfaces of the auxiliary package when the packaging is closed such that the auxiliary packaging supports the contacted panels of the packaging. The auxiliary package may include a fastening element adhered to a surface of the auxiliary package, wherein the fastening element adhered to the surface of the auxiliary package is cut from a panel of the packaging. The auxiliary package may be adhered to an interior surface of a panel of the packaging, and may include an open side that is closed by a cooperating panel of the packaging when the cooperating panel of the packaging is folded into a closed configuration.

The packaging wholly envelops the auxiliary packaging when the packaging is in a closed configuration such that the auxiliary packaging is not visible. The packaging panels are scaled to closely hold the auxiliary packaging within the packaging, such that the auxiliary packaging provides structural support to the finished packaging when the finished packaging is in a closed configuration. Miter surfaces may be disposed at fold lines of the single layer foldable blank, wherein when the panels are in a folded configuration, the opposing miter surfaces engage one another to form an opposing structure as a 90-degree corner.

The mitered folds and complementary edges present a finished, clean, flawless appearance, and increase structural integrity of the packaging. The tab locks formed from the single panel optimize material usage and provide a secure, intriguing solution to securing packaging in a closed configuration. Miter surfaces may be disposed at fold lines of the single layer foldable blank. When the panels are in a folded configuration, the opposing miter surfaces engage one another to form an opposing structure and a finished edge on an outer edge of the packaging. Miter surfaces may be disposed at complementary edges of the panels of the packaging where the assembled edges form a 90-degree angle, further configured such that in a closed configuration the miter surfaces contact and are parallel with one another, thereby forming a sharp corner. When three panels are folded together at a right angled corner, the corner includes mitered surfaces of the three complementary edges that meet at a single corner point.

To keep the product protected and secure during transport, handling, or storage, the packaging may include additional packaging components, e.g., a small sleeve or box to secure documents or other products. The additional packaging component may further enhance the structural integrity of the packaging and add support when the panels are folded to form the finished box. The cooperation of the folded configuration, mitered folds and complementary edges, efficient locking tabs, and recycled material balance each of the aforementioned goals—including eco-friendliness, aesthetic design, structural robustness, cost, and ease of manufacturing.

The packaging may be retail packaging (i.e., finished packaging for containing and conveying a product to a user such as may be used in a retail setting, not shipping packaging providing outer packaging for containing a packaged product during shipment) that one may expect to find on the shelf in a retail store, and which one may open after purchase to directly access their product. A product contained by the packaging may be, for example, an electronic device such as, for example, headphones, a laptop, tablet computer, or smartphone, or it may be a non-electronic device, such as, for example, a book. In any case, the packaging may contain additional elements housing the product (e.g., headphones within a case).

These and other embodiments are discussed below with reference to the accompanying figures. However, those skilled in the art will readily appreciate that the detailed description given herein with respect to these figures is for explanatory purposes only and should not be construed as limiting.

FIG. 1 shows a closed configuration of packaging 10. As shown, packaging 10 is generally formed from a single blank, folded from multiple panels having miter-cut folds and miter-cut complementary edges. This imparts a seamless impression onto packaging 10, and provides added structural integrity to the finished packaging 10. With the opposing angles of the miter folds and complementary edges, the forces imparted during normal use of packaging 10 are better transferred into the panels of packaging 10 without excessive strain or deformation, and without panels flexing or bending out of place relative to each other. On the outside, when closed, the packaging appears to have a clean and neat outer appearance—it appears to be a simple box.

In contrast to packaging that may be configured as a sleeve, or a top lid, holding an inner base box that in turn holds the product, with a single integrated blank and the folded configuration shown in FIGS. 2-7, an entirely new unboxing experience is available to the end-user. In FIG. 1, packaging 10 is shown in a vertical orientation in a closed configuration. As shown, each edge is a sharp edge due to the miter cuts at folds and complimentary edges. When a user desires to open packaging 10, the packaging may be rotated backwards, with the back panel being laid on a surface to allow for the front panel 100 to be lifted and rotated open. As will be apparent in further figures, side panel 112 is a portion of a compound fold configuration that comprises a portion of a flat cross-shaped blank, folded to become a side panel of packaging 10.

Figure 2:
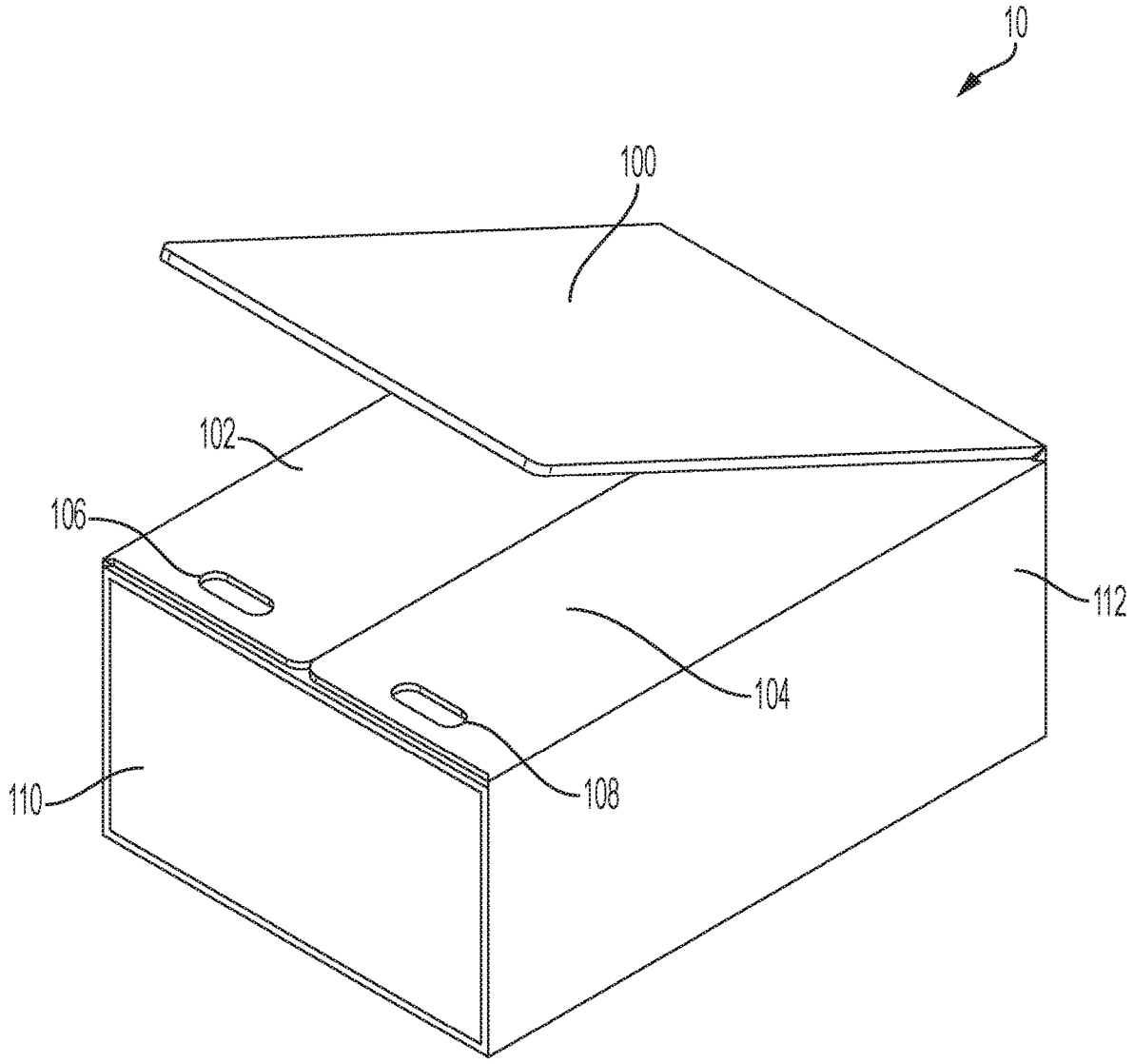
FIG. 2 shows a partially opened configuration of the packaging shown in FIG. 1.

Turning to FIG. 2, packaging 10 is shown rotated backwards such that the front panel 100 may be opened and rotated backwards, away from side panel 102 and side panel 104. Side panels 102/104 each contain cutouts 106/108, respectively. In some embodiments, each of the locks on packaging 10 are on the same side of the box, when the box is in the closed configuration. In some embodiments, cutouts 106/108 may be formed as an elongated pill shape, for example. In other embodiments, cutouts 106/108 may be formed in another shape, such as a circle, rectangle, or other shape (such as a brand identifying shape or logo). Panel 110 is shown for reference in FIG. 2, and in FIG. 1 is disposed on the bottom of packaging 10. The portion of panels 102/104 that are cut out of the respective panels such that cutouts 106/108 formed are fixed to an inner surface of panel 100 as fasteners 118/120, respectively (see FIG. 3). Fasteners 118/120 are positioned such that they engage cutouts 106/108, respectively, as a friction fit and may be generally planar (because they are cut from a planar panel). The friction fit may be configured to secure panel 100 closed during normal handling conditions, but when a user desires to open packaging 10, they may lift panel 100 away from side panels 102/104, such that panel 100 may fold away and lie flat along with top panel 116, as shown in FIGS. 3-7. This set of fasteners/cutouts secures an up-and-down direction of unfolding, (by securing the panels that have only side-to-side fold lines), and also simultaneously secures a side-to-side direction of unfolding (by securing the panels that have only up-and-down fold lines) such that when unlocked, the entire box can be collapsed open flat in the up-and-down and side-to-side directions.

Only the rear panel (middle of the T-shape) has fold lines in both up-and-down direction and side-to-side direction.

Figure 8:
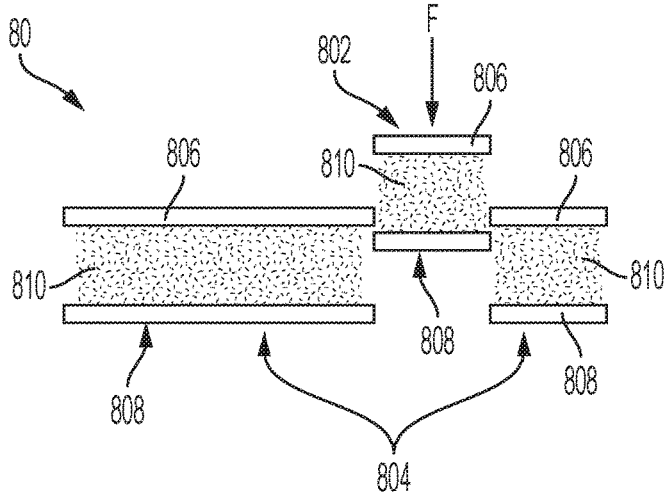
FIG. 8 shows a schematic view of a tab lock.

When engaged, outer edge sides of the fasteners are in contact with inner edge sides of cutouts. This basic configuration is shown with reference to FIG. 8, showing fastening system 80. As shown, panel 804 includes a cutout from which fastener 802 is cut (shown unattached to a separate panel for clarity). Each of the panel 804 and fastener 802 includes top surface 806 and bottom surface 808. Between those two surfaces, fill 810 is sandwiched. As such, the panel material forms a skin surrounding a raw interior. As shown in FIG. 8, the skins (i.e., top and bottom surfaces 806/808) can catch on each other in the locking configuration, which with their close correspondence in shape, helps to keep the locks together and avoid inadvertent separation. In this way, lateral movement in any lateral direction is constrained. This helps to keep all panels from moving relative to each other. As shown in the figures, only relative upward movement of the panels can remove the fasteners from the cutouts and free the panel to be unfolded.

Figure 3:
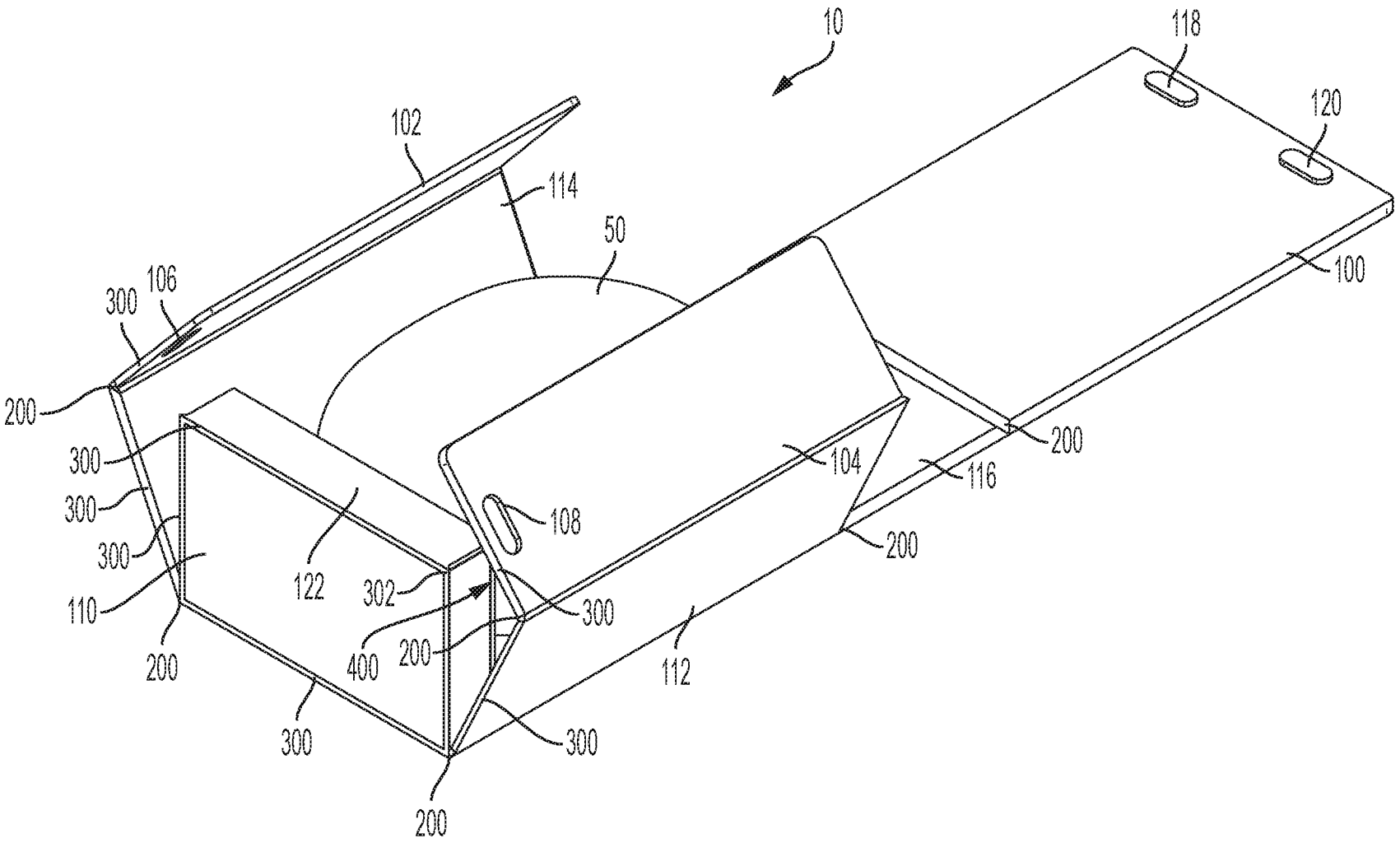
FIG. 3 shows a further opened configuration of the packaging shown in FIG. 1, showing the sides of the packaging folding open.
Figure 9:
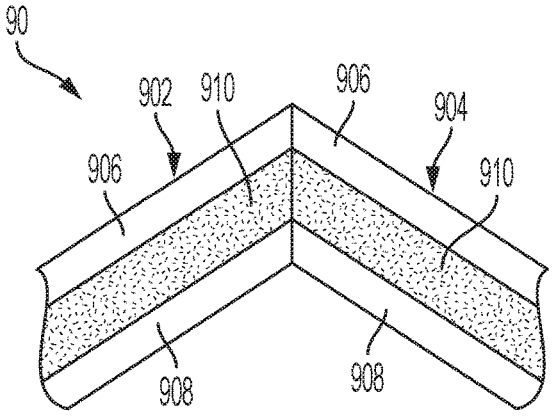
FIG. 9 shows a schematic view of a complementary edge of two panels meeting at mitered edges.

Comparing FIG. 1 to FIG. 3, the finished edges of packaging 10 in the closed configuration form simple, sharp corners, as a result of miters 200 at the fold lines (allowing for a sharp corner fold on the exterior of the box and additional support at the folded corners). Additionally, edges 300 are also mitered (e.g., cut or chamfered to have complementary angles, such as 45 degrees each to form a 90 degree angle) such that when the panels are folded in the closed configuration of packaging 10, complementary edges form sharp corners. Complementary edges are shown as any set of edges that come together to form a corner in the folded/closed configuration. As shown in FIG. 9, an example of mitered edges is shown as element 90. The edge includes panel 902 and 904, each having top surface 906 and bottom surface 908. Between those two surfaces, fill 910 is sandwiched. As such, the panel material forms a skin surrounding a raw interior. As shown in FIG. 9, the skins (i.e., top and bottom surfaces 906/908) can catch on each other in the folded configuration, adding additional structural integrity to the corners. When three panels come together in a folded configuration, e.g., panels 104, 11, and 110 at corner 302 (see FIG. 3), each panel includes mitered edges such that the three panels come together at a sharp point, adding to both the aesthetic appeal of the packaging as well as structural integrity. Additional flaps or other elements that bridge the edge may be omitted (as one might do to hide a seam, for example).

Figure 10:
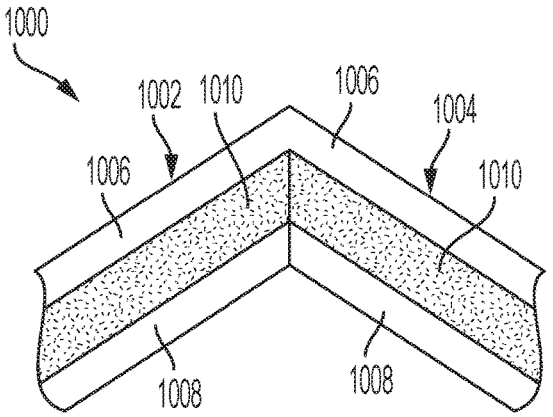
FIG. 10 shows a schematic view of a complementary fold of two panels meeting at a folded mitered corner.

With miters 200 at the fold lines, when a panel is folded, the skin on the far side of a miter cut may be what remains, and provides the fold. FIG. 10 shows a schematic view of such a configuration. FIG. 10 shows a folded mitered panel, having panel 1002 and 1004 (folded from a single panel). Each of the panels includes top surface 1006 and bottom surface 1008. Between those two surfaces, fill 1010 is sandwiched. As such, the panel material forms a skin surrounding a raw interior. As shown in FIG. 10, the skins that are cut (i.e., surfaces 1008) can catch on each other in the folded configuration, adding additional structural integrity to the corners.

Once fasteners 118/120 are unlocked (i.e., removed from cutouts 106/108) side panels 102/104 may be rotated away to the side along with side panels 112 and 114. This movement further reveals product 50 within packaging 10. Bottom panel 110 is shown still folded in with panel 122 folding over and closing auxiliary packaging 400. Auxiliary packaging 400 may contain, for example cords, accessories, product literature, etc. The side panels can wrap around the auxiliary packaging 400 in contact with it, which can give the structural form some additional ballast to maintain its shape.

Figure 4:
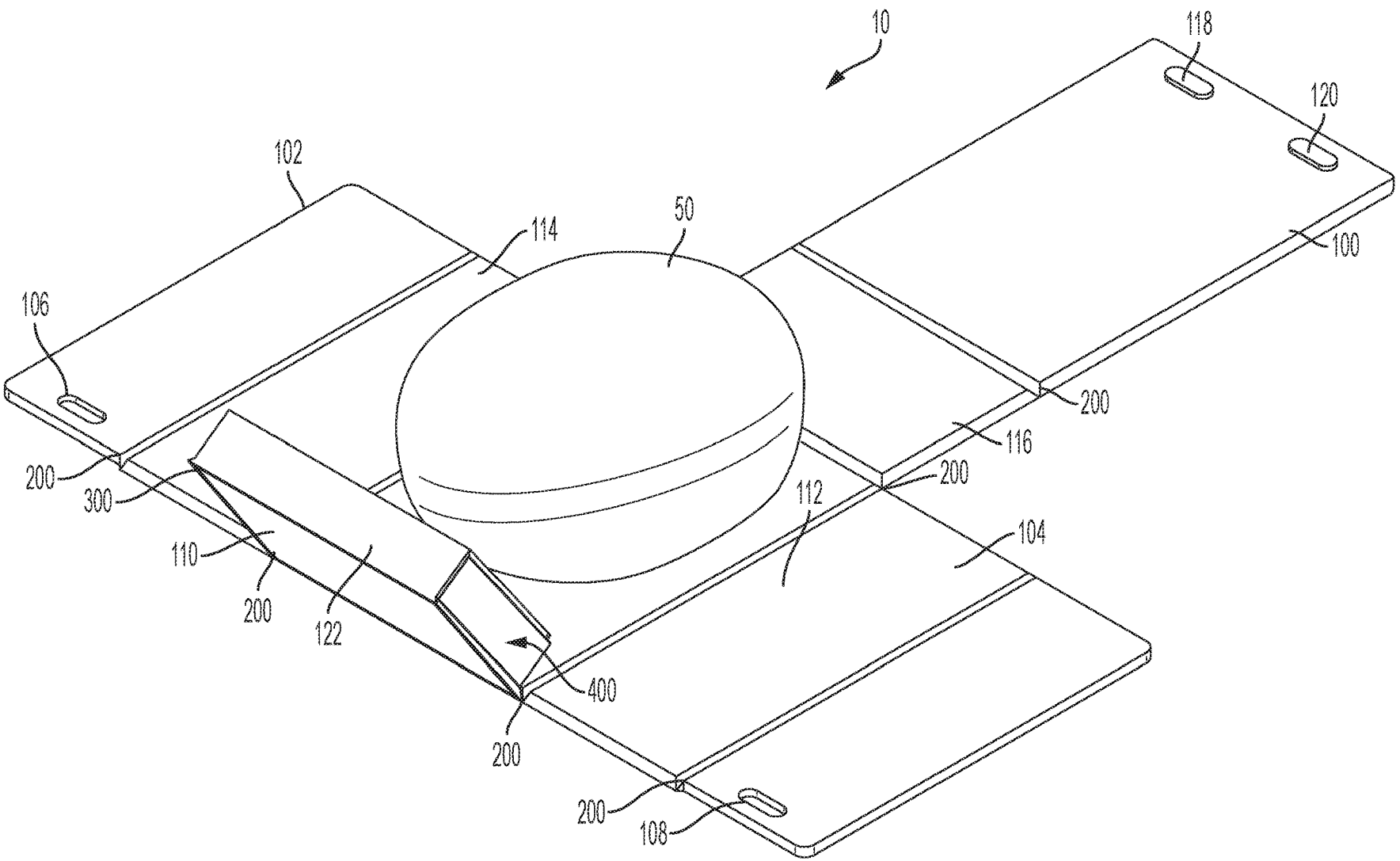
FIG. 4 shows a further opened configuration of the packaging shown in FIG. 1, showing the front and sides of the packaging lying flat, while the bottom panels fold away and show a smaller auxiliary packaging held by the bottom panels of the packaging.

As shown in FIG. 3, packaging 10 opens symmetrically with respect to panels 102/104. Advantageously, this leads to a clean outer appearance and provides additional structural integrity when fasteners 118/120 are engaged with cutouts 106/108, respectively. Moving from FIG. 3 to FIG. 4, panels 112 and 104 fold outwards and lie flat, as do panels 114 and 102. FIG. 4 shows packaging 10 taking on a cross-shaped configuration as an extended single panel. However, panels 122 and 126 of packaging 10 are still shown in a folded configuration.

Figure 5:
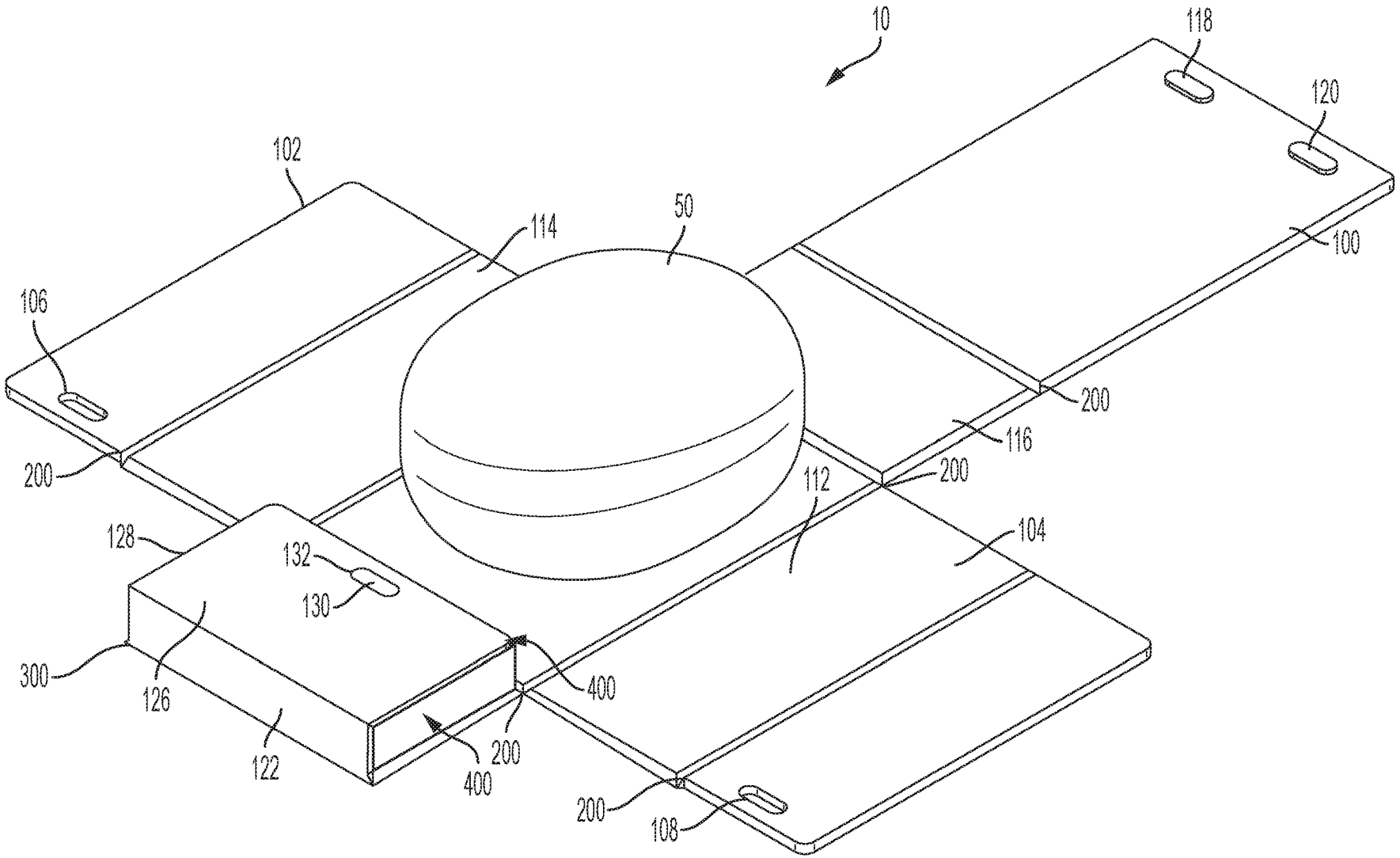
FIG. 5 shows a further opened configuration of the packaging shown in FIG. 1, the bottom panel portion of the packaging locked to the auxiliary packaging with the tab lock.

Turning to FIG. 5, as with side panels 102/104 having cutouts 106/108, respectively, panel 126 includes cutout 132. And as with cutouts 106/108, cutout 132 may be formed as an elongated pill shape, for example. In other embodiments, cutout 132 may be formed in another shape, such as a circle, rectangle, or other shape (such as a brand identifying shape or logo). Cutout 132 is aligned with the portion cut out from the panel that is fixed to panel 402 of auxiliary packaging 400 as fastener 404. Fastener 404 is positioned such that it engages cutout 132 as a friction fit. The friction fit may be configured to secure auxiliary packaging 400 to packaging 10 during normal handling conditions, but when a user desires to access auxiliary packaging 400, they may lift panel 126 away from panel 402, such that auxiliary packaging 400 may be accessed. With each of the cutouts 106/108/132, and their accompanying fasteners, packaging 10 is provided with the best possible fit of fasteners, as each of the matching cutout/fastener pairs is cut from corresponding panel. There is no need to account for variation in tolerance, e.g., if a fastener was to be placed in a cutout that the fastener was not cut from, or otherwise formed separately.

In some embodiments, an auxiliary packaging 400 may be otherwise free within packaging 10, such that fastener 404 engaging with cutout 132 is the only mechanism positioning auxiliary packaging 400 within packaging 10. In some embodiments, auxiliary packaging 400 may be adhered to a surface of an interior panel packaging 10, such that panel 126 and panel 122 cooperate with such an inherent side to fix auxiliary packaging 400 within packaging 10.

Figure 6:
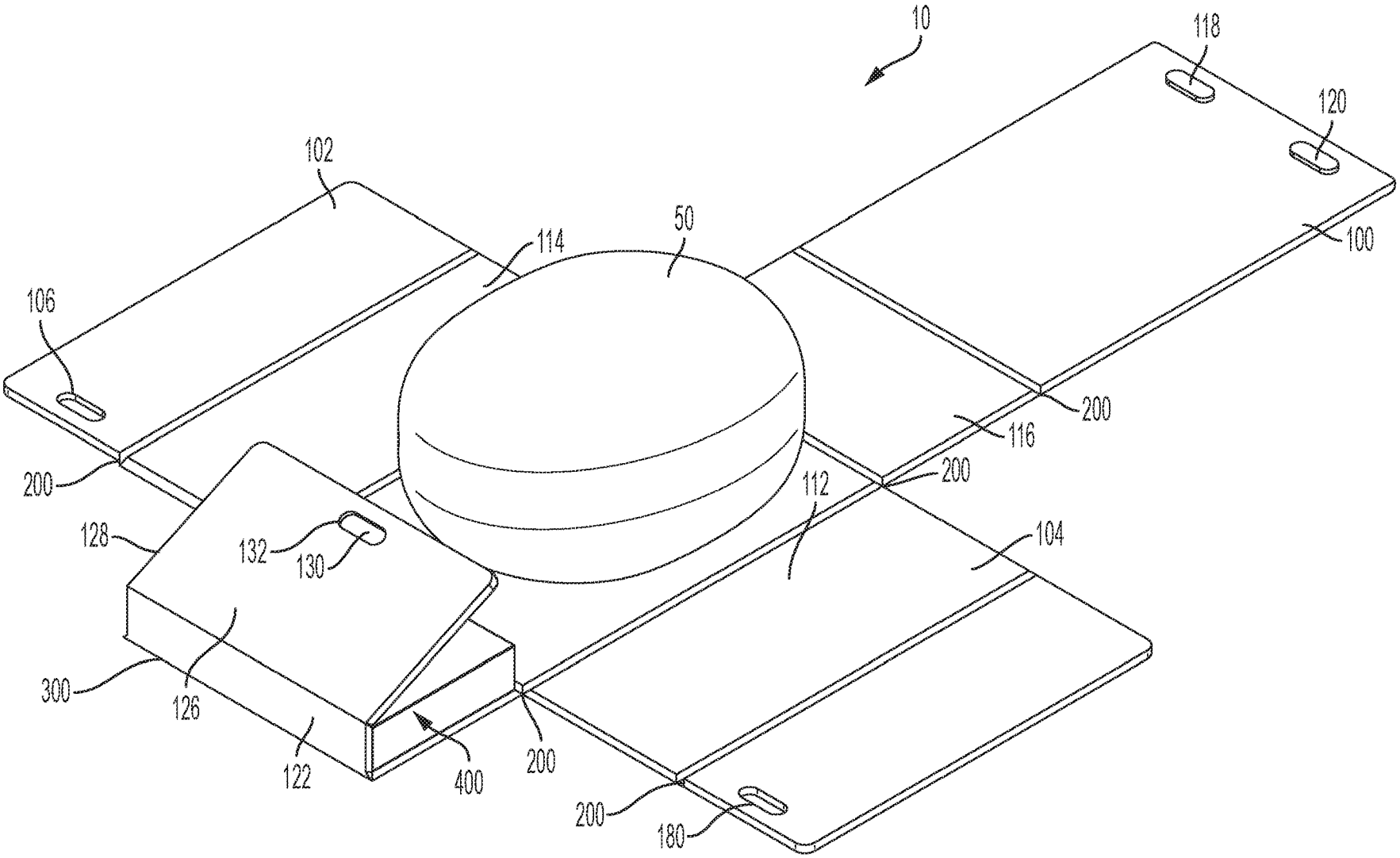
FIG. 6 shows a further opened configuration of the packaging shown in FIG. 1, the tab lock holding the smaller auxiliary packaging being opened.
Figure 7:
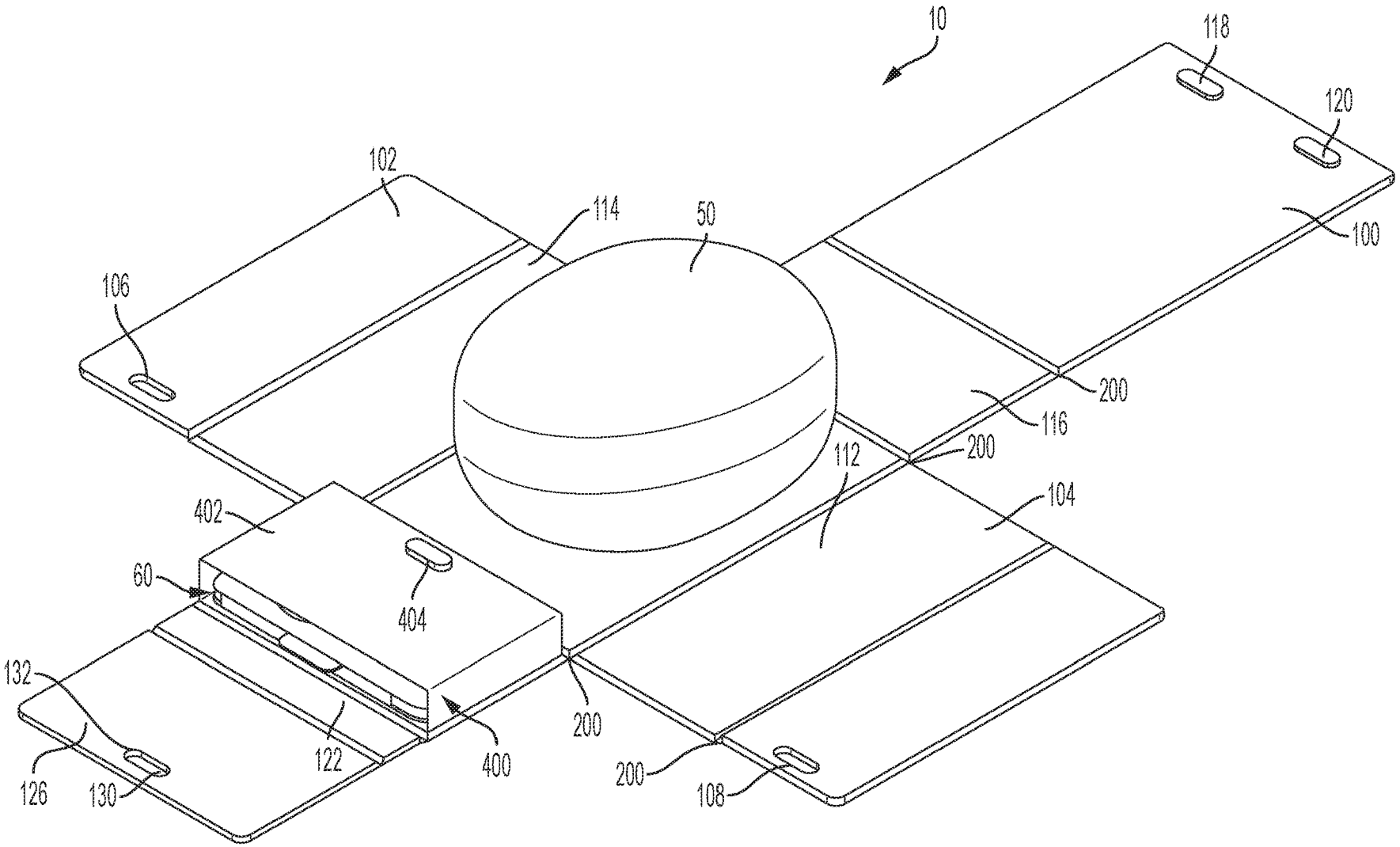
FIG. 7 shows a further opened configuration of the packaging shown in FIG. 1, the tab lock holding the smaller auxiliary packaging being further opened such that a product may be removed from the auxiliary packaging.

FIG. 6 and FIG. 7 show panel 126 opening away from a top surface 404 of auxiliary packaging 400 to expose and provide access to product 60, housed within auxiliary packaging 400. Auxiliary packaging 400 may be a smaller box, and may be fully enclosed. However, as shown in FIG. 6 and FIG. 7, auxiliary packaging 400 may be formed as a sleeve or partial sleeve packaging component, such that a panel (e.g., panel 122) of packaging 10 forms a sidewall of auxiliary packaging 400 in a closed configuration, and when packaging 10 is opened (e.g., panel 126 rotated fully away such that it lies flat), an opening to the interior of auxiliary packaging 400 is made available.

Additionally, the packaging may be manufactured in a cost-effective and environmentally-friendly way. In some embodiments, packaging 10 may be constructed of a single integrally-formed piece of material. The single integrally-formed piece of material may be a foldable material that is folded into a configuration that holds and secures a product, either alone or within a cavity of a packaging container. In some embodiments, the foldable material may be a single piece of material that is cut by a single operation (e.g., a single die-cutting operation). In some embodiments, the foldable material may be die cut from a stock material (e.g., a sheet or roll of material). Single integrally-formed pieces of material that are cut by a single cutting operation may facilitate efficient and reproducible manufacturing. Moreover, such manufacturing may reduce waste by reducing waste material during manufacturing.

The packaging components may be composed of a recyclable material (e.g., a biodegradable or compostable material). If and when the customer opts to dispose of the packaging, because the entire packaging is recyclable and cellulose-based, the packaging may simply be recycled without requiring material separation (e.g., in a single-stream recycling program).

Advantageously, this improves upon prior systems having, for example, folded trays or bowed lower base boxes, which produce gaps between the components that may provide an unfinished or disjointed appearance. By designing the relative dimensions between the corresponding features of the base box 40, support structure 30, and tray 20, product, assembly, or packaging tolerance issues still result in secure packaging having a gapless appearance.

Packaging 10 is constructed to give a clean, unitary appearance. This helps to reinforce its high quality and robust character, and that of the product 50. To achieve this appearance, seams, gaps, and raw material edges are minimized through the chamfering of the miter cuts of raw edges, hiding the edges in the folded configuration (raw material edges are edges formed by cutting through a flat material, where the substance of the material between its outer flat surfaces is revealed). Packaging 10 may be a particular color, e.g., a brand-identifier color. In some embodiments, visible surfaces of packaging 10 may be predominantly black, a color that cannot easily be achieved in recyclable cellulose-based materials, particularly in less-expensive common greyboard or corrugated cardboard. In some embodiments, the material is not post-treated, e.g., not coated in any additive, etc.

Components of packaging 10 may be formed from a single blank. In some embodiments, the blank is formed of a single continuous substrate, such as, for example cellulose-based material like cardboard or paperboard. Tabs, flaps, and regions without adhesive of the blank are folded such that no adhesive is visible in finished packaging 10. In some embodiments, adhesive may be omitted and the various flaps and tabs attached in another suitable manner (e.g., by mechanical interlock or press fit). Fold lines may be formed, for example, by weakening the substrate along the lines, such as by perforation, material crushing, scoring, miter cutting, etc.

In some embodiments, any surface finishing may take place after the components are cut from the blank, or alternatively prior to the blank being cut into separate sheets for assembling to a final product. Additionally, some operations may be performed concurrently.

It is well understood that the use of personally identifiable information should follow privacy policies and practices that are generally recognized as meeting or exceeding industry or governmental requirements for maintaining the privacy of users. In particular, personally identifiable information data should be managed and handled so as to minimize risks of unintentional or unauthorized access or use, and the nature of authorized use should be clearly indicated to users.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not intended to be exhaustive or to limit the embodiments to the precise forms disclosed. It will be apparent to one of ordinary skill in the art that many modifications and variations are possible in view of the above teachings.

What is claimed is:

1. Packaging, comprising:

a single layer foldable blank, the single layer foldable blank comprising:

panels foldable to enclose a product;

a planar fastening element cut from a first one of the panels, forming an opening therein, and adhered to a second one of the panels such that the first and second panels are configured to retain at least a portion of the packaging in a closed configuration when the planar fastening element is disposed within the opening, wherein the packaging is convertible between a flat configuration and a secured configuration without adding or removing elements.

2. The packaging of claim 1, further comprising:

an auxiliary package disposed within the packaging and positioned such that the panels contact surfaces of the auxiliary package when the packaging is closed such that the auxiliary packaging supports the contacted panels of the packaging.

3. The packaging of claim 2, wherein the auxiliary package further comprises:

a fastening element adhered to a surface of the auxiliary package, wherein the fastening element adhered to the surface of the auxiliary package is cut from a panel of the packaging.

4. The packaging of claim 2, wherein the auxiliary package is adhered to an interior surface of a panel of the packaging.

5. The packaging of claim 2, wherein the auxiliary package comprises an open side that is closed by a cooperating panel of the packaging when the cooperating panel of the packaging is folded into a closed configuration.

6. The packaging of claim 2, wherein the packaging wholly envelops the auxiliary packaging when the packaging is in a closed configuration such that the auxiliary packaging is not visible.

7. The packaging of claim 2, wherein the packaging panels are scaled to closely hold the auxiliary packaging within the packaging, such that the auxiliary packaging provides structural support to the finished packaging when the finished packaging is in a closed configuration.

8. The packaging of claim 1, further comprising:

miter surfaces disposed at fold lines of the single layer foldable blank, wherein when the panels are in a folded configuration, opposing miter surfaces engage one another to form an opposing structure as a 90-degree corner.

9. The packaging of claim 1, further comprising:

miter surfaces disposed at fold lines of the single layer foldable blank, wherein when the panels are in a folded configuration, opposing miter surfaces engage one another to form an opposing structure and a finished edge on an outer edge of the packaging.

10. The packaging of claim 1, further comprising:

miter surfaces disposed at complementary edges of the panels of the packaging where the assembled edges form a 90-degree angle, further configured such that in a closed configuration the miter surfaces contact and are parallel with one another, thereby forming a sharp corner.

11. The packaging of claim 1, wherein the packaging is formed from cellulose-based materials.

12. The packaging of claim 1, wherein the packaging comprises a single continuous sheet of cellulose-based material.

13. Packaging, comprising:

a foldable, cross-shaped blank configured to fold between an open configuration and a closed configuration, the blank comprising:

a first panel configured to support a product when the blank is in the open configuration, wherein the first panel is a side panel when the blank is in the closed configuration;

a second panel and a third panel extending symmetrically from the first panel such that they fold upward to form sidewalls of the packaging in the closed configuration;

a fourth panel extending from the second panel;

a fifth panel extending from the third panel, wherein the fourth and fifth panels extend symmetrically and each include a cutout;

a sixth panel extending from the first panel in a direction perpendicular to the direction in which the second and third panels extend, and foldable above the second and third panels to form a top panel in the closed configuration;

a seventh panel extending from the sixth panel having the cutouts of the fourth and fifth panels fixed to it as fastening elements, wherein the fastening elements are insertable into to the cutouts to maintain the packaging in a closed position; and a bottom portion forming the bottom of the packaging in the closed configuration.

14. The packaging of claim 13, further comprising:

an eighth panel forming a portion of the bottom of the packaging in the closed configuration and extending from the opposing side of the seventh panel, wherein the eighth panel folds upwards and engages complimentary edges of the second, third, fourth, and fifth panels at mitered edges of the respective panels.

15. The packaging of claim 14, further comprising:

ninth and tenth panels extending sequentially from the eighth panel away from the first panel, wherein the ninth and tenth panels are foldable to partially enclose an auxiliary package within the packaging, wherein surfaces of the auxiliary package engage the inner surfaces of the second, third, fourth, and fifth panels.

16. The packaging of claim 15, the tenth panel including a cutout, wherein the cutout of the tenth panel is fixed to the auxiliary packaging as a fastening element, wherein the fastening element is insertable into to cutout of the tenth panel as a friction fit to maintain the position of the tenth panel with respect to the auxiliary packaging.

17. The packaging of claim 15, wherein the ninth panel closes an opening of the auxiliary packaging when the ninth panel is in a folded configuration.

18. The packaging of claim 13, wherein the seventh panel extends along the entirety of the front surface of the packaging in a closed configuration.

19. The packaging of claim 13, wherein the fifth and sixth panels are symmetrical in both the closed configuration and the open configuration, and wherein the cutouts are disposed spaced from a lower edge of the packaging in the closed configuration such that the fastening elements are disposed on a lower side portion of the packaging.

20. The packaging of claim 13, where at least one of the closes an opening in an auxiliary package disposed within the packaging.

21. The packaging of claim 13, wherein the packaging is formed from cellulose-based materials.

22. The packaging of claim 13, wherein the packaging comprises a single continuous sheet of cellulose-based material.

23. Packaging, comprising:

a single layer foldable blank, the single layer foldable blank comprising:

panels foldable to enclose a product;

an element adhered to a second one of the panels such that the first and second panels are configured to retain at least a portion of the packaging in a closed configuration when the element is disposed within an opening formed in a first one of the panels; and miter surfaces disposed at complementary edges of the single layer foldable blank, wherein when three panels are folded together at a right angled corner, the corner includes mitered surfaces of the three complementary edges that meet at a single corner point.

24. The packaging of claim 23, wherein the packaging comprises a single continuous sheet of cellulose-based material.

25. The packaging of claim 23, wherein the packaging is formed from cellulose-based materials.

26. The packaging of claim 23, wherein additional miter surfaces are disposed at fold lines of the single layer foldable blank, wherein when the panels are in a folded configuration, opposing miter surfaces engage one another to form an opposing structure as a 90-degree corner.

27. The packaging of claim 23, wherein the packaging is convertible between a flat configuration and a secured configuration without adding or removing elements.

* * * * *